US007195465B2

(12) United States Patent
Kane et al.

(10) Patent No.: US 7,195,465 B2
(45) Date of Patent: Mar. 27, 2007

(54) RECIPROCATING MICROFLUIDIC PUMP SYSTEM FOR CHEMICAL OR BIOLOGICAL AGENTS

(76) Inventors: David Kane, 7 Leslie Terrace, Rawley, MA (US) 01969; Nicoi McGruer, 265 Dedham St., Dover, MA (US) 02030

( * ) Notice: Subject to any disclaimer, the term of this patent is extended or adjusted under 35 U.S.C. 154(b) by 0 days.

(21) Appl. No.: 10/265,277

(22) Filed: Oct. 4, 2002

(65) Prior Publication Data

US 2005/0249605 A1 Nov. 10, 2005

Related U.S. Application Data

(60) Provisional application No. 60/327,759, filed on Oct. 5, 2001, provisional application No. 60/327,760, filed on Oct. 5, 2001, provisional application No. 60/228,883, filed on Aug. 29, 2000.

(51) Int. Cl.
*F04B 17/00* (2006.01)

(52) U.S. Cl. ..... 417/413.1; 417/413.2; 417/53

(58) Field of Classification Search ..... 417/410.1, 417/412, 413.1, 413.2, 53
See application file for complete search history.

(56) References Cited

U.S. PATENT DOCUMENTS 4,938,742 A * 7/1990 Smits ..... 604/67
4,944,659 A * 7/1990 Labbe et al. ..... 417/413.2
5,466,932 A * 11/1995 Young et al. ..... 250/289
6,116,866 A * 9/2000 Tomita et al. ..... 417/413.2
6,164,933 A * 12/2000 Tani et al. ..... 417/413.2
6,261,066 B1 * 7/2001 Linnemann et al. ..... 417/53
6,280,148 B1 * 8/2001 Zengerle et al. ..... 417/44.1
6,623,256 B2 * 9/2003 Takagi et al. ..... 417/413.2
6,869,275 B2 * 3/2005 Dante et al. ..... 417/413.2

* cited by examiner

*Primary Examiner*—Charles G. Freay

(57) ABSTRACT

A miniature pump has at least one controllable expansion-and-contraction chamber, and associated pair of tiny ducts interconnecting a fluid source and destination. The ducts communicate with the chamber(s); an linking tunnel links the ducts. Valves interact with fluid pressures due to expansion and contraction, imposing directionality on flow in the ducts and tunnel. Preferences: making the valve a passive flapper, implanting the pump in a creature, making the source a medication reservoir for supplying the creature; making the source a fuel tank and destination a tiny engine; making the source provide a specimen for assay and destination an observation slide; human or automatic examination of the slide under a microscope (e. g. electron microscope); making the source a reagent and destination a process stream; making the source a colorant and destination a colorant application system. Preferably included is an optical channel with intersecting fluid duct for optically monitoring pumped fluid.

30 Claims, 10 Drawing Sheets
(1 of 10 Drawing Sheet(s) Filed in Color)

A B C

Detector
852, 852r
Computer
873
874
Alarm or access
870
872
Processor (integrated)
873a
868
862
867, 862
845
841
842
867
840
17
λ Source
841'
842'
846b'
846a'
871"
Organ
Circulatory System
871
841'
871'
agent in reservoir

RECIPROCATING MICROFLUIDIC PUMP SYSTEM FOR CHEMICAL OR BIOLOGICAL AGENTS

RELATED PATENT DOCUMENT

This patent document claims priority from provisional application 60/327,759, filed Oct. 5, 2001.

Wholly incorporated by reference herein are copending, coowned provisional applications Ser. 60/228,883, filed Aug. 29, 2000, and 60/327,760, filed Oct. 5, 2001. The first of these applications later became the basis of U.S. patent application Ser. No. 10/142,654—which issued Feb. 15, 2005 as U.S. Pat. No. 6,856,718; and the second (a companion case to this one) became U.S. patent application Ser. No. 10/265,278—eventuating as issued U.S. Pat. No. 6,934,435.

BACKGROUND

There has been an ongoing research effort to integrate microfluidic-based systems with appropriate sensors and analytical components. An objective has been effective miniaturization of chemical and biological assays, with the creation of a lab-on-a-chip technology.

A defining attribute of microassays is small amounts of gas or liquid material required for sample reaction. This economy of scale affords the ability to test more compounds or drug candidates for a desired or undesired reaction.

In addition, microreaction technology offers efficient heat transfer and the potential for optimized mixing and safer processing—in other words, better reaction control, as well as reduced waste. Because both the sample size and the reaction quantities are so small, multiple individual assays can be run in parallel, affording more reliable results.

Such reaction systems are amenable to construction in a parallel fashion to increase throughput. Alternatively, specimens can be attached to parallel systems to allow simultaneous performance of multiple different assays.

While many companies have brought the lab-on-a-chip technology to the forefront of microelectromechanical system (MEMS) applications, these developments heretofore have failed to fully integrate the pumping and detection functions. An a result, none of these earlier efforts can achieve major advances in either miniaturization or biomedical applications.

It is not intended to unduly criticize such prior work, which is noteworthy and admirable. Nevertheless it does leave room for refinement.

SUMMARY OF THE INVENTION

The present invention provides such refinement, partly by introducing a now aspect of microfluidics and sample mixing. The present section of this document will first offer an informal introduction, which is not to be taken as limiting the scope of the invention; and then a perhaps-more-rigorous summary.

This innovation combines a pumping mechanism and detection mechanism in the same substrate. Certain preferred embodiments of the invention include a microfluidic pump, diaphragm membrane, waveguide-based optical crossconnect, and an actuator substrate. The optical crossconnect is detailed in the above-mentioned patent documents.

Integrating the reciprocating microfluidic pump system of this invention into a microchip allows the invention to be applied to both chemical and biological assays. The microfluidic pump (or "micropump") system essentially combines the benefits of miniaturization, integration and automation while also solving complex design problems such as controlling and directing sample flow at intersections of micron scale.

The micropump can use multiple columns and chambers. It is advantageous in that it allows samples to accumulate and mix through a fluid path—and thus allows longer column lengths and continuous detection. Thereby the invention enhances the potential for more accurate data averaging.

Certain preferred embodiments of the invention incorporate a planar silicon, silica or polymer waveguide, with a chemical/biological sampling chip utilizing certain of the elements in the prior MEMS-based all-optical switch technology. Apparatus according to the invention can include a nonblocking planar-waveguide-based switch, or switch array, such as the "fluid-based actuator-stroke amplification" system ("FASA") which is taught in the first above-mentioned patent—and which may also be called a switch "fabric".

Given the foregoing informal orientation, a more-formal summary follows:

In preferred embodiments of its first major independent facet or aspect, the invention is a miniaturized fluid pump system that includes a substrate and at least one controllable expansion-and-contraction chamber formed in the substrate. Also included are a pair of substantially microscopic ducts, respectively communicating with a fluid source and a fluid destination—and at least one of the ducts communicating with the chamber.

In addition the first main aspect or facet of the invention includes a linking tunnel, distinct from the chamber, formed in the substrate and communicating with both ducts. (It may be noted that the distinctness of this tunnel from the chamber sets the invention apart from that of e. g. Tani, U.S. Pat. No. 6,164,933, in which the only cross-tunnel is identical with the chamber itself.) It also includes at least one exclusively passive valve interacting with fluid pressures due to expansion and contraction, respectively, to impose a directionality upon fluid flow in the ducts and tunnel.

The foregoing may represent a description or definition of the first aspect or facet of the invention in its broadest or most general form. Even as couched in these broad terms, however, it can be seen that this facet of the invention importantly advances the art.

In particular, by including a linking tunnel and passive rather than active valves (as in, e. g., Smits, U.S. Pat. No. 4,938,742), the overall pumping operation is essentially slaved to expansion and contraction of the chamber. This very greatly simplifies electrical connections, synchronization requirements etc. and thereby renders the system far more efficient.

Although the first major aspect of the invention thus significantly advances the art, nevertheless to optimize enjoyment of its benefits preferably the invention is practiced in conjunction with certain additional features or characteristics. In particular, preferably the at least one exclusively passive valve is a passive flapper.

Another primary preference is that the substrate be implanted within a living creature. If this main preference is observed, then two subpreferences are that the fluid source be a chamber for medication to be delivered to the creature; and also that the chamber be implanted within the creature.

Another preference is that the fluid source be a fuel tank; and the fluid destination be a substantially microscopic engine. Yet another preference is that the fluid source provide a specimen for assay; and the fluid destination be a slide for observation.

Still another main preference is that the invention encompass the pump system in further combination with a microscope; in this case the slide is for human observation under the microscope. If this main preference is observed, then a subpreference is that the microscope be an electron microscope.

A still-further preference is that the invention encompass the pump system in further combination with some means for automatic examination. (For purposes of generality and breadth in discussing the invention, these means may be called simply the "automatic-examination means".) The slide is for automatic examination by the automatic-examination means. Two alternative preferences are that the fluid source be a reagent and the fluid destination a process stream; and that the fluid source be a colorant and the fluid destination be a colorant application system.

Another particularly noteworthy preference is that the invention encompass the pump system in further combination with an optical monitoring device. The monitoring device includes a monitoring-device substrate, and formed in that substrate a channel for passage of an optical signal.

Intersecting the optical-signal channel is a column for movement of fluid into and out of the optical-signal channel. These provisions are for optical monitoring of the fluid—particularly, where applicable, the fluid pumped by the pump system.

If this particularly noteworthy preference is observed, then several subpreferences arise: first, it is best that the combined pump system and monitoring device further includes some means for displacing fluid along the column to control placement of the fluid relative to the optical-signal channel, for optical monitoring of the fluid.

A second subpreference is that the displacing means include another controllable expansion-and-contraction chamber, formed in the monitoring-device substrate and communicating with the column. Still another subpreference, also applicable to the two subpreferences just stated and especially useful, is that the monitoring-device substrate be substantially integrated with the pump-system substrate.

In preferred embodiments of its second major independent facet or aspect, the invention is a method for moving a fluid from a fluid source to a fluid destination. The method includes disposing the fluid in a miniaturized fluid pump system that comprises:

a substrate, at least one controllable expansion-and-contraction chamber formed in the substrate, at least two substantially microscopic ducts, communicating with the fluid source and with the destination, at least one linking tunnel, distinct from the chamber, formed in the substrate and aligned with at least two of the ducts, and at least one exclusively passive valve interacting with fluid pressures due to expansion and contraction, respectively.

The passive valve, in particular, operates to impose a directionality upon fluid flow in the at least one chamber and the at least two ducts.

The method of this second main aspect of the invention also includes the step of controlling expansion and contraction in the at least one chamber. This controlling stop drives fluid from the source to the destination.

The foregoing may represent a description or definition of the second aspect or facet of the invention in its broadest or most general form. Even as couched in these broad terms, however, it can be seen that this facet of the invention importantly advances the art.

In particular, this method aspect of the invention enjoys the same advantages mentioned above, relative to Smits and Tani (for example), with respect to the passive valves as well as the tunnel distinct from the active chamber.

Although the second major aspect of the invention thus significantly advances the art, nevertheless to optimize enjoyment of its benefits preferably the invention is practiced in conjunction with certain additional features or characteristics. In particular, preferably the method further includes the step of observing a specimen of the fluid. In this case the source provides the specimen for assay, and the fluid destination is a slide for observation.

If the foregoing primary preference is observed, then a subpreference is that the observing step comprise observation under a microscope, and the slide be for human or machine observation under a microscope. Here an alternative subpreference is that the observing step comprise observation under an electron microscope, and the microscope be an electron microscope for human or machine observation of the specimen.

In preferred embodiments of its third major independent facet or aspect, the invention is a miniaturized fluid pump system that includes a substrate having at least one generally planar surface. Also included is at least one controllable expansion-and-contraction chamber formed in the substrate.

This third facet of the invention also includes a first microscopic straight duct formed in the substrate and intersecting the surface substantially at right angles, and communicating directly with the chamber. It also includes a second substantially straight duct formed in the substrate substantially parallel to the first duct and also intersecting the surface. One of these ducts communicates with a fluid source and the other of the ducts communicates with a fluid destination.

Also included is a linking tunnel, distinct from the chamber, formed in the substrate substantially parallel with the surface and communicating with both ducts. Further included is at least one valve associated with each of the ducts, respectively, and interacting with fluid pressures due to expansion and contraction to impose a directionality upon fluid flow in the ducts and tunnel.

The foregoing may represent a description or definition of the third aspect or facet of the invention in its broadest or most general form. Even as couched in these broad terms, however, it can be seen that this facet of the invention importantly advances the art.

In particular, the geometry just described imparts to this aspect of the invention an extremely beneficial simplicity and ease of manufacture. The invention is thereby made particularly economic.

Although the third major aspect of the invention thus significantly advances the art, nevertheless to optimize enjoyment of its benefits preferably the invention is practiced in conjunction with certain additional features or characteristics. In particular, preferably each of the at least one valves is an exclusively passive valve.

Also applicable to this third main facet of the invention are the preferences mentioned earlier, particularly in connection with the first aspect of the invention—and in related to incorporation of an optical monitoring device with the pump. As before, the monitoring device preferably includes a monitoring-device substrate having a channel formed in it for passage of an optical signal; and, intersecting the optical-signal channel, a column for movement of fluid into and out of the optical-signal channel.

The monitoring-device substrate and column are for optical monitoring of the fluid. The several other preferences previously mentioned in this regard also apply here.

The foregoing benefits and advantages of the invention will be more fully appreciated from the following Detailed Description of Preferred Embodiments, considered in conjunction with the appended illustrations—of which:

BRIEF DESCRIPTION OF THE ILLUSTRATIONS

The patent or application file contains at least one drawing executed in color. Copies of this patent or patent application publication with color drawing(s) will be provided by the Office upon request and payment of the necessary fee.

FIG. 1 is a diagram, highly schematic, including complementary plans (A views, above) and elevational cross-sections (B views, below)—the latter very greatly enlarged—of a light-switch fabric;

FIG. 2 is a set of three photographs—the left-hand "A" view being a natural perspective view of a 250:1 scale model prototype apparatus in which a form of the invention was reduced to practice; the center "B" view being an actual image produced by the apparatus with the actuator relaxed, and accordingly showing total internal reflection of the beam at the column; and the right-hand "C" view being a like image but with the actuator extended, and therefore showing substantially undeflected transmission of the beam through the intersection;

FIG. 3 is a set of two elevational cross-sections, copied from the above-mentioned '435 patent and its precursor applications, of a waveguide assembly according to preferred embodiments of the invention—the left-hand or "A" view showing the actuator extended, and the right-hand "B" view showing it contracted and retracted;

FIG. 4 is a set of three cross-sectional views, all somewhat schematic or diagrammatic, of a first embodiment that is formed with one or more flappers, for directional flow control, and having a pair of actuator chambers with respectively associated pairs of wells and flappers, each chamber and well being generally analogous to the FIG. 3 single chamber and well—here the topmost or "A" view being in plan, taken along the line 4A—4A in the central or "B" view; and the central and lower, or "B" and "C", views being taken along the line 4B—4B in the "A" view; and the "B" and "C" views showing the actuator retracted and extended respectively;

Figure 7:
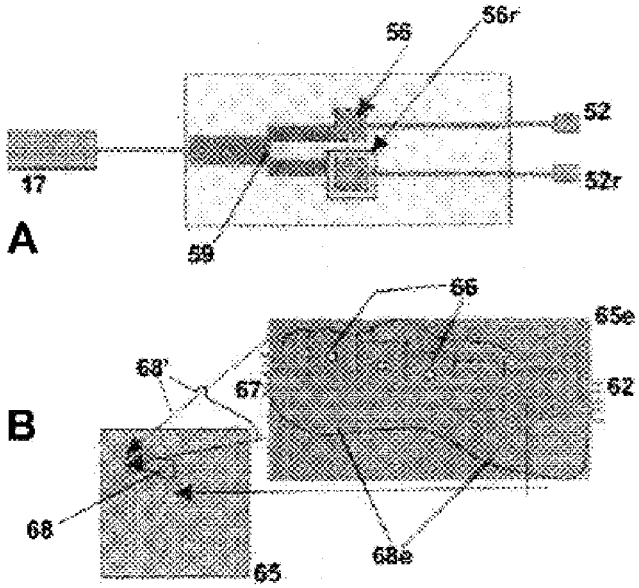
Figure 8:
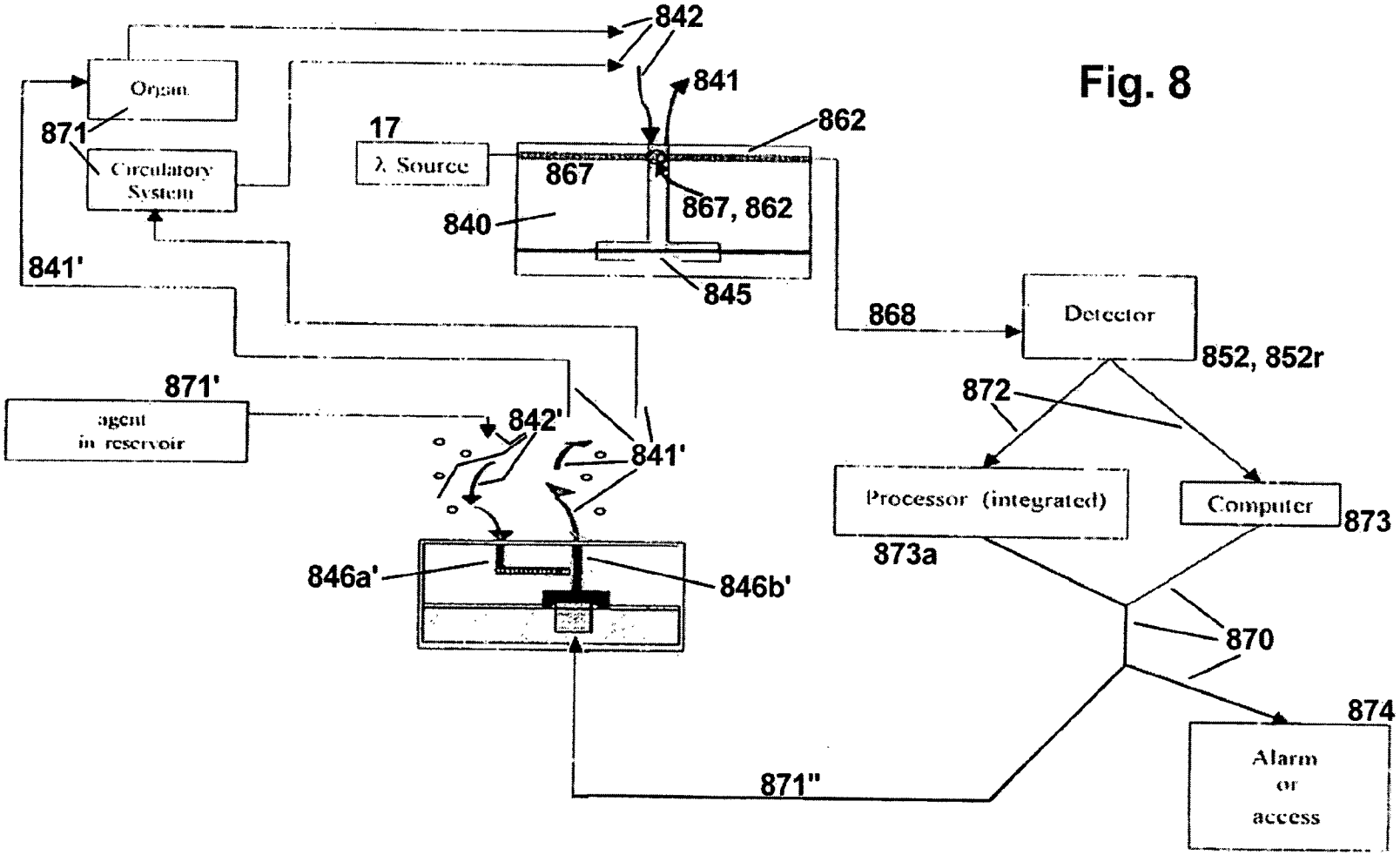
Figure 9:
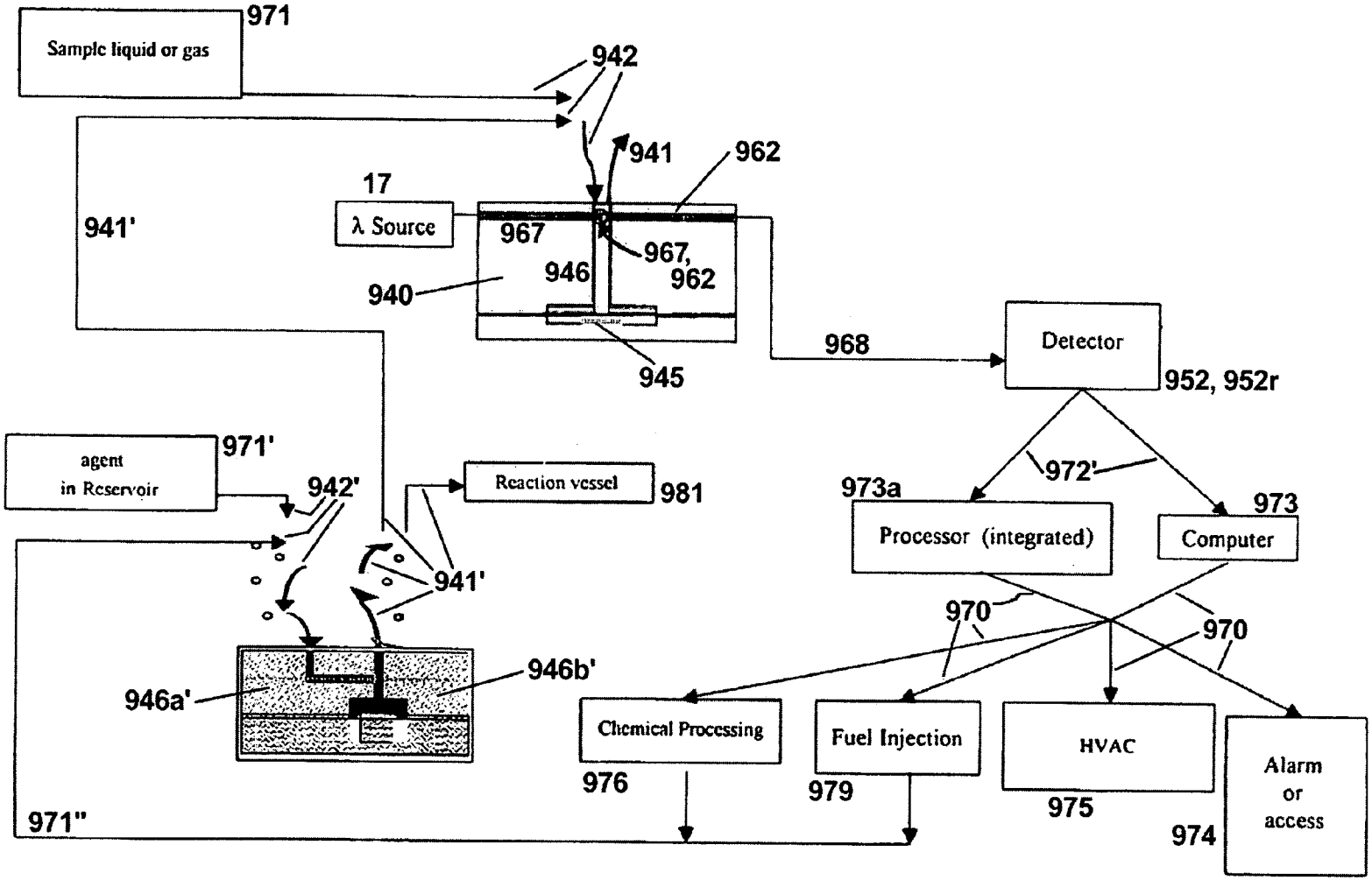
Figure 10:
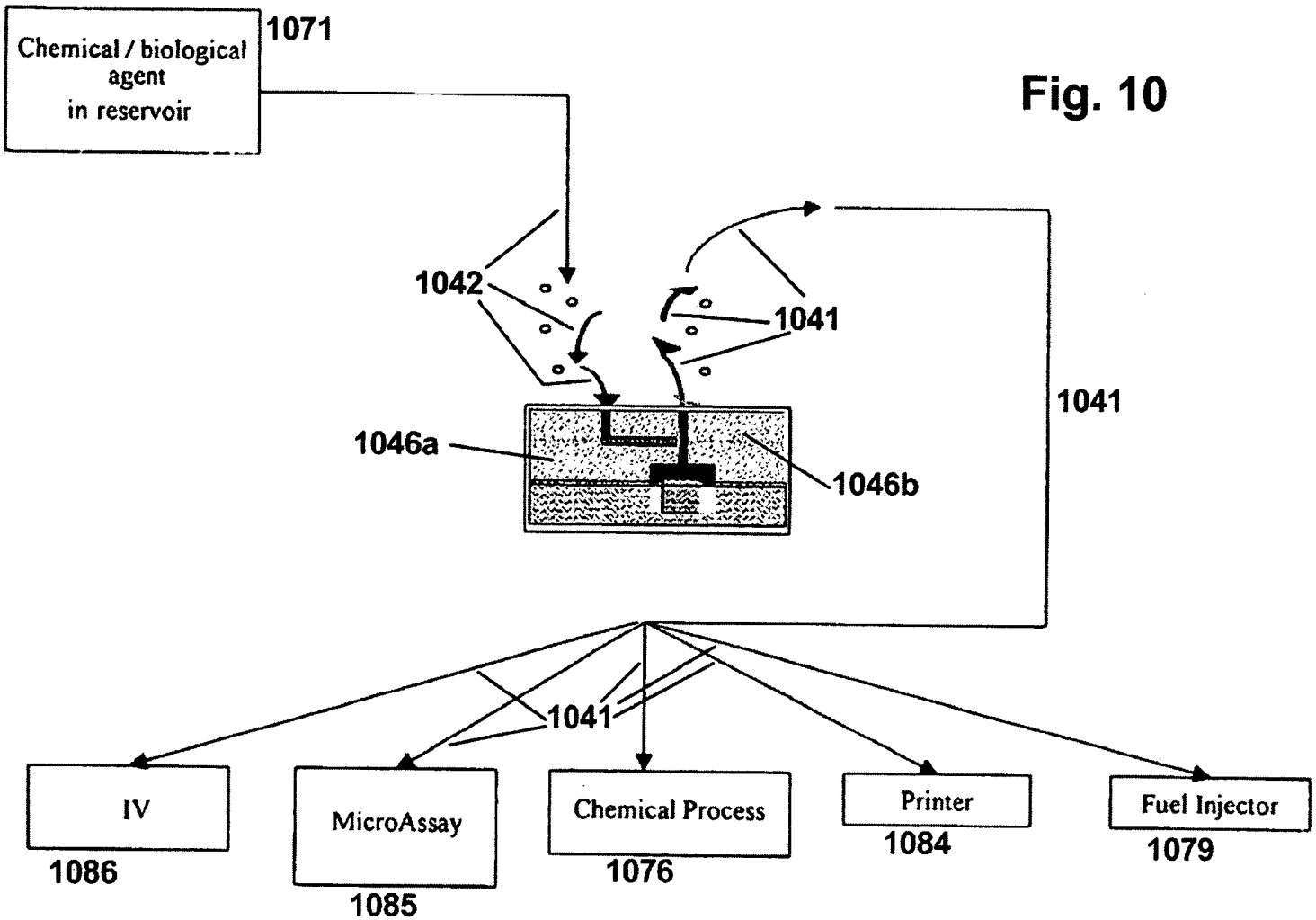

FIG. 7 is a pair of diagrams, both highly schematic, that show exemplary preferred embodiments of the invention—the upper or "A" diagram representing a two- (sample and reference) fluorescence and/or polarization configuration of the invention; and the lower "B" diagram being two views of a chemistry/biology chip with a pump and waveguide system (the overall chip array 65 includes a representative portion 68, seen in greater detail in an enlarged view 65*e*, 68*e*—which is "exploded" from the overall array 65 along lines 68');

FIG. 8 is a first of three system or block diagrams, also highly schematic, of a microfluidic pump and waveguide sensor system that can be either external or implanted (the term "implanted" here being used to encompass implantation in a device as well as in a living organism)—for chemical or biological agent identification and detection applications; this FIG. 8 system being particularly intended for biological monitoring or dispensing, or both;

FIG. 9 is a second of the three diagrams, of a pump-and-sensor system particularly intended for industrial monitoring or dispensing; and FIG. 10 is a third such diagram, of a system particularly intended for industrial dispensing.

DETAILED DESCRIPTION OF PREFERRED EMBODIMENTS

A. Switching

Figure 1:
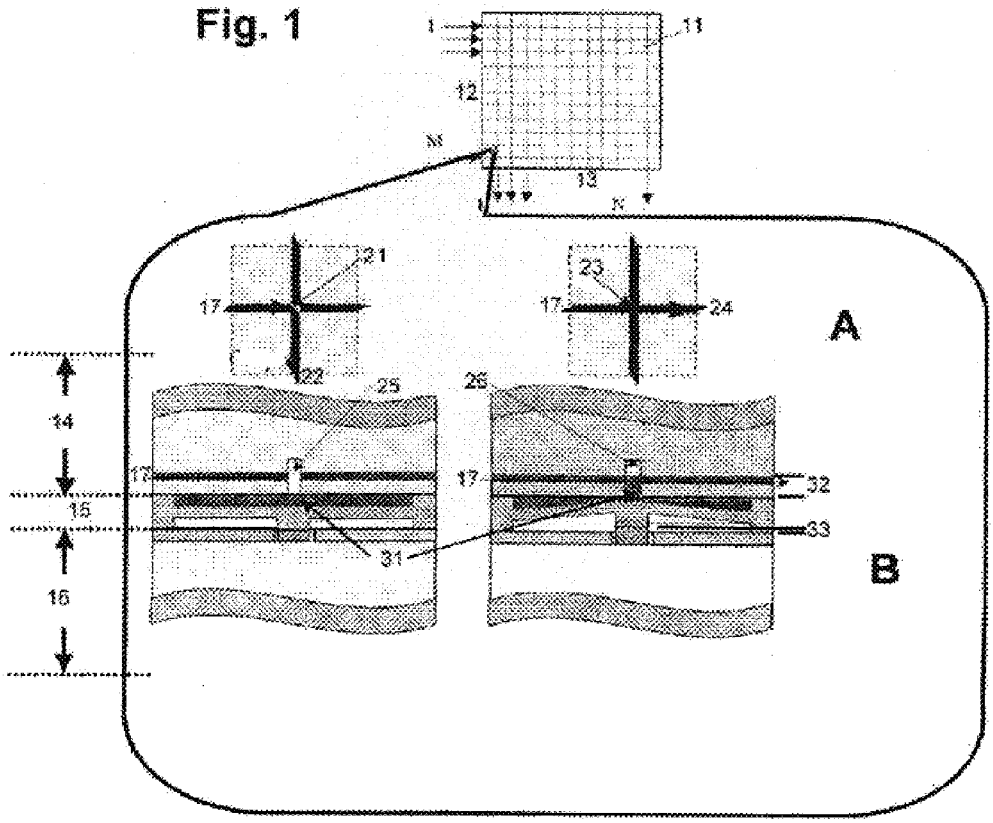

As a three-layer substrate sandwich structure or "switch fabric" 11 (FIG. 1), the switch of preferred embodiments includes a waveguide in a substrate 14, membrane substrate 15, and actuator substrate 16. Central to the operation of this switch is the actuator 15–16, used to fill and empty the columns, and the expanded gas 25 and pressurized gas 26 as shown.

The switch works by moving the sample fluid located in the columns by a distance 32 that can be called "ΔX". It is this actuation aspect that serves as the pumping mechanism, and reciprocation is caused by changes in relative pressure within the multiple chambers.

With the actuator relaxed, gas 25 is present at the waveguide channel interface 21 (left-hand views). Total internal reflection results at that point 21, and the entering light 17 is there deflected ninety degrees to leave the crossing waveguide 22.

With the actuator extended, gas 26 at the top of the column is compressed—inserting index-matched fluid into the waveguide-channel interface 23. Internal reflection no longer occurs, and the entering light 17 is instead transmitted substantially straight through the interface to instead exit from the direct extension 24 of the entry waveguide.

The microfluidic pump system of this invention thus takes advantage of the incompressibility of the index matching fluid and the ratios of the column-to-reservoir cross-sectional areas. An actuator extends Δx, displacing fluid up the column ΔX to complete the light circuit—with the fluid allowing light to continue traveling through the waveguide in one direction or the other as detailed above.

ΔX/Δx ratios of greater than 1000:1 are possible, based on the column and reservoir cross-sectional areas envisioned. The total internal reflection (TIR) is represented by a column of triangular cross-section located at the intersection of each input and output optical channel in the waveguide substrate.

When a switched state is desired, the actuator is retracted by Δx and the pressurized gas 26 returns the column to its original location. With a lower-index gas at the waveguide interface, as noted earlier total internal reflection occurs at the column-waveguide interface and the incoming light is switched 90°. Switch speed is dependent on the time it taken to move the column ΔX.

Figure 2:
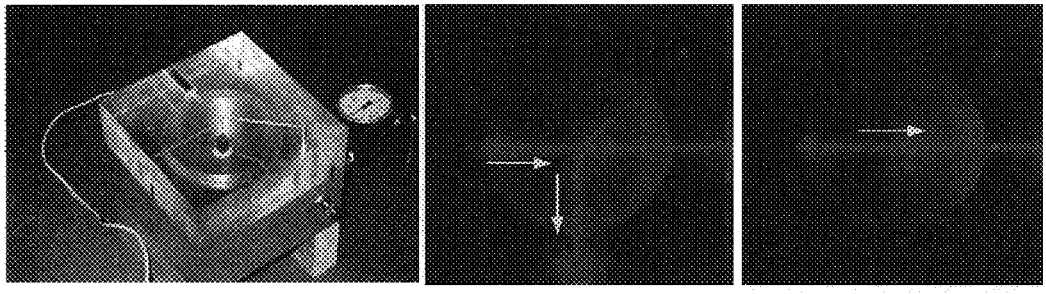

A 250:1-scale acrylic/polycarbonate prototype A (FIG. 2) of a single actuator/fluid column junction with 500:1 stroke amplification has been demonstrated to verify the concept. Actual deflection B and direct transmission C were observed and recorded.

B. Pumping—Basic Forms

Figure 3:
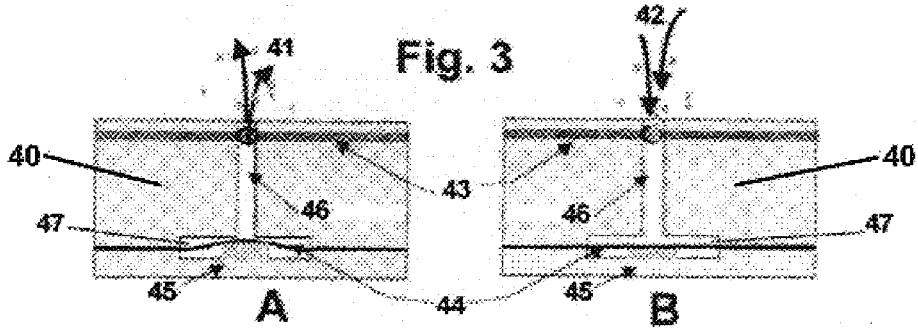

The concept of the microfluidic pump system of this invention incorporated into a chem/bio chip utilizes the same elements as the optical switch in a micropump configuration, for moving the fluid 42 (FIG. 3) into a sensor field of view. An advantage provided by this pump configuration is that the fluid-velocity ratios are proportional to the column-to-reservoir ratio of cross-sectional areas.

An actuator 45 extends its membrane 44 at a rate $\Delta x/\Delta t$, displacing fluid 41 up and out of the column 46 toward the waveguide 43, at a greater rate $\Delta X/\Delta t$—thus expelling the initially present agent 41 from the optical-interaction region of the column. The actuator then completes the light circuit with fluid 42, drawn into the interaction region, while allowing light to continue traveling through the waveguide 43.

The ratio of the individual ratios $\Delta X/\Delta t/\Delta x/\Delta t$ can exceed 1000:1, based on the column and reservoir cross-sectional areas envisioned. In this preferred embodiment, the top of the column is open to the external environment.

In this configuration the microfluidic pump system is used as a displacement pump, expelling and drawing the agents of interest into the waveguide interaction region as just described. Center-to-center distances for each sample site can be on the order of 100 to 200 μm, with displacement frequencies in excess of 1 MHZ.

The resulting volumetric transfer rate is on the order of $10^{-5}$ L/sec (ten microliters per second). The power consumption is 200 mW at 5 V.

Multiple detection configurations are envisioned utilizing the microfluidic-pump systems of this invention. Detection approaches that can utilize the microfluidic pump and planar waveguide of any embodiments of the invention include, but are not limited to:

fluorescence, polarization, refractive-index variation, acoustooptic tunable filters, Fabry-Perot interferometry, and "μ-scale" grating spectrometry.

The microfluidic pump system of the invention in combination with the waveguide can detect both chemical and biological agents in liquids or in gases. Examples of such detection applications include but are not limited to blood or other bodily fluid monitoring, use as a chemical sensor for process control, leak detection or safety monitoring; or use as a biological sensor for use in detecting and monitoring toxins.

Other examples described below include monitoring a heating/ventilation and/or air-conditioning system, monitoring a fuel-injection system, monitoring a chemical processing system, or triggering an alarm.

The microfluidic pump system, alone, can be used in pump applications such as dispensing drugs, externally or as an implant, as an assay dispenser, as a means of moving liquids and gases within the field of view of a detection system, or even to assist a heart pump, or other similar applications.

As will be seen from certain of the embodiments discussed below, the reciprocating microfluidic pump system of the invention may sometimes perhaps be more accurately described as a "recirculating" microfluidic pump system. Some embodiments of the invention can be used not only in embodiments that include a waveguide, but also in combination with a nonreciprocating microfluidic pump.

C. Pumping—Plural-Duct Forms

Figure 4:
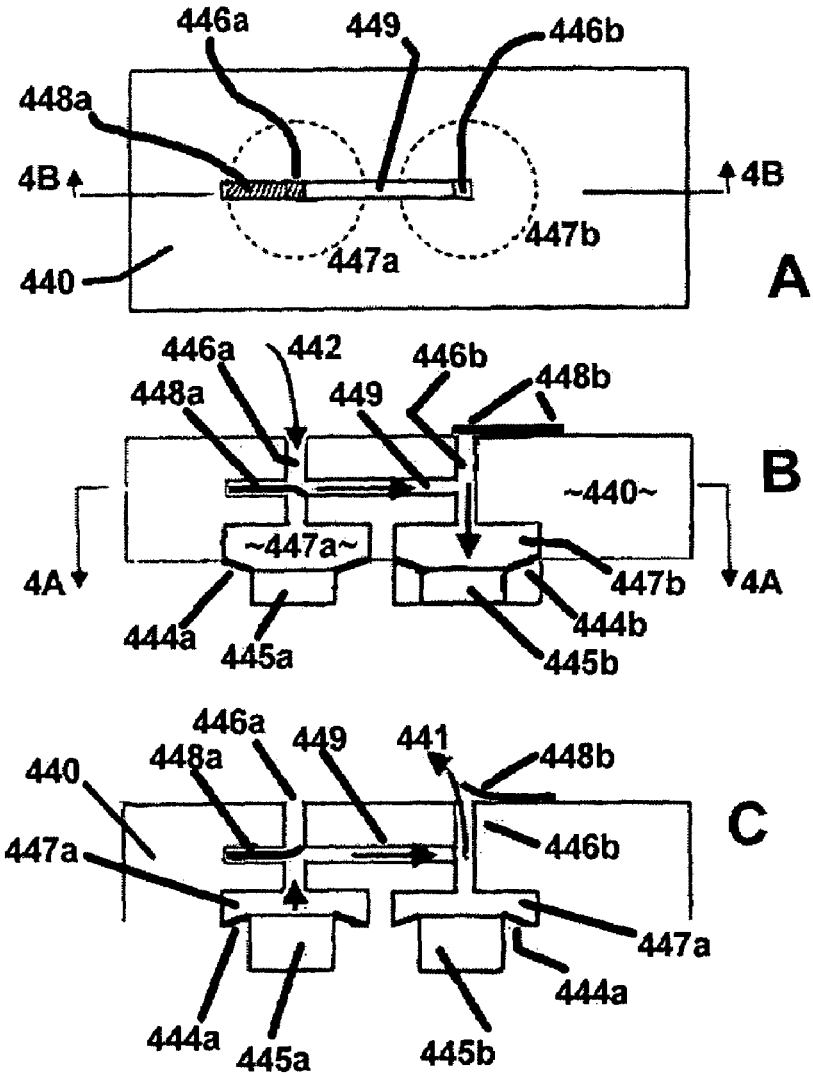

One preferred embodiment of the invention is configured as a reciprocating microfluidic pump that has two chambers 447*a*, 447*b* (FIG. 4). These chambers in turn have associated columns or ducts 446*a*, 446*b* respectively, linked by an interconnecting tunnel 449.

The chambers also have actuators 445*a*, 445*b* that contract and expand in tandem. Both actuators, connected to the membranes or diaphragms 444*a*, 444*b* in their respective chambers 447*a*, 447*b*, contract during an intake or "ingestion" phase (FIG. 4B). The resulting increases in the chamber volumes draw fluid into the first chamber 447*a*.

A flapper valve 448*a*, cantilevered perpendicular to the intake column 446*a*, is pulled toward the actuator by the fluid flow downward in that column—thus diverting fluid from that column 446*a* into the linking tunnel 449. A second flapper 448*b*, covering the second column 446*b*, prevents fluid from entering the second chamber 447*b* via the top of that second column. The flapper positions result in a net positive pressure difference between the chambers 447*a*, 447*b*.

During an expulsion phase (FIG. 4C), the actuators 445*a*, 445*b* expand, reducing the chamber volumes. The flappers of both chambers are pushed away from the actuators due to fluid motion. The flapper 448*a* at the first chamber 447*a* diverts fluid from that chamber toward the second chamber 447*b*, through the linking tunnel 449, with a net flow of fluid out of that second chamber.

Consequently the flow through the two chambers and passageways is in the same direction during both phases (actuator contraction and expansion) of the system. The overall result of each reciprocation of the actuators 445*a*, 445*b* is therefore to pump fluid in through the first column 446*a*, thus functioning as an intake port, and out through the second column 446*b* as an exhaust port.

In addition to providing a pump for sensor technology, the reciprocating microfluidic pump system of this invention can be used to dispense medicines in small doses as an implant in the body. In an alternate configuration (not shown) the flapper over the second column is eliminated, and the flapper at the first column continues to provide an appropriate flow resistance, producing a net circulation into the first column 446*a* and out of the second column 446*b*.

Figure 5:
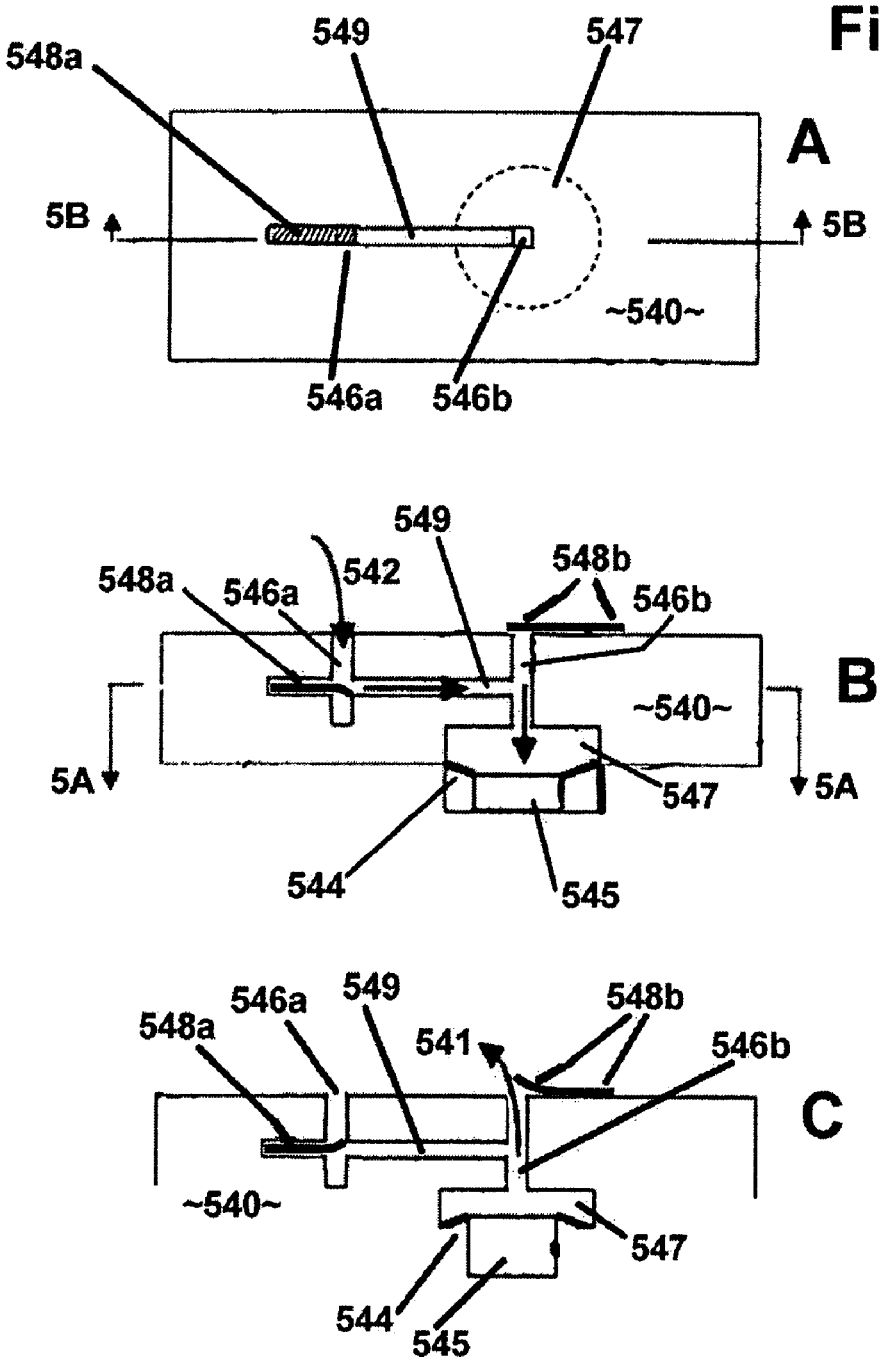
FIG. 5 is a set of three views, generally like those of FIG. 4 but of a second embodiment with flappers, and here having a single actuator chamber but a pair of wells—and with the "A" view being taken along the line 5A—5A of the "B" view, while the "B" and "C" views are taken along the line 5B—5B of the "A" view.

Other configurations similar to this, with one or more chambers and two or more columns, are also possible. Thus another preferred embodiment utilizes only a single chamber 547 (FIG. 5)—but with an analogous network of three ducts 546*a*, 549, 546*b*.

In this configuration, the flappers 548*a* and 548*b* at the two columns 546*a*, 546*b* operate just as the flappers discussed above. When the single actuator 545 contracts (FIG. 5B), the chamber volume increases and fluid flows into the first column 546*a*, through the linking tunnel 549 and down the second column 546*b* into the chamber 547.

The flapper valve 548*b* over the second column 546*b* is closed. The flapper 548*a* perpendicular to the first column 546*a* is displaced by the flow through that column 546*a* and the linking tunnel 549, allowing flow into the chamber 547 due to the relative pressure.

When the actuator expands (FIG. 5C), the volume of the one chamber decreases and the flapper at the top of the second column 546*b* opens—allowing flow out of that column—and the flapper inside the second column 546*a* is displaced but prevents flow out of column 1.

This cycle continues indefinitely, resulting in a reciprocating pumping action very generally as before. Since only one chamber is in use, this system moves only a fraction as much fluid as the two-chamber embodiment (FIG. 4) discussed above.

Figure 6:
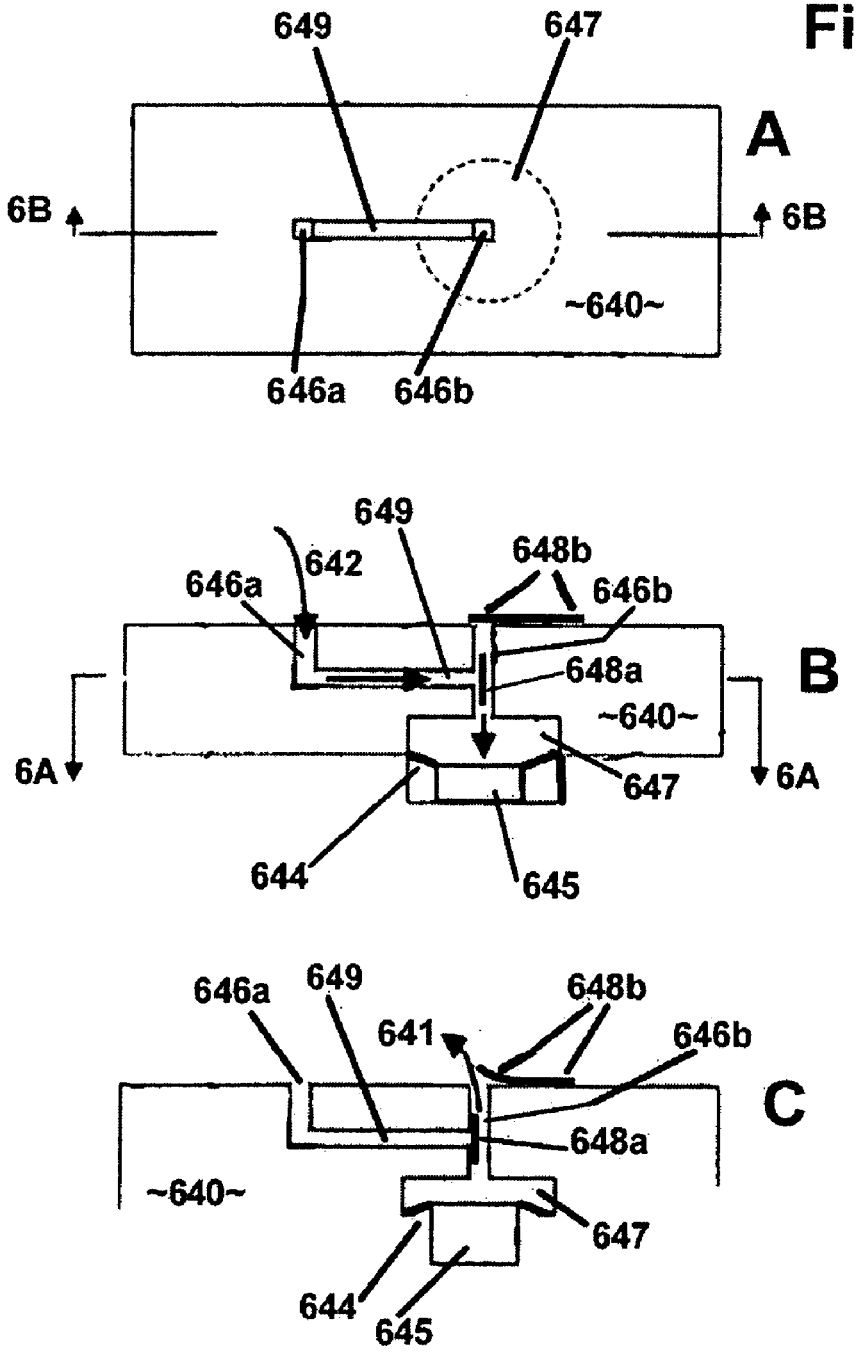
FIG. 6 is another three-view set, but of a third flapper embodiment, here having not only a single chamber but also a single flapper—and with the "A" view being taken along the line 6A—6A of the "B" view, while the "B" and "C" views are taken along the line 6B—6B of the "A" view.

Yet another preferred embodiment has a single chamber 647 (FIG. 6), as in the embodiment just discussed, but with one of the flappers located at the intersection between the linking tunnel 649 and the second column 646*b*. When the actuator 645 contracts (FIG. 6B), the chamber volume increases—and intake fluid flows into the first column 646*a*, thence through the linking tunnel 649, and finally down the second column 646*b* into the chamber 647.

The flapper 648*b* over that second column 646*b* is closed, and another flapper 648*a*—just at the intersection between the linking tunnel 649 and the second column 646*b*—is open. That intersection flapper thus allows flow into the chamber due to the relative pressure.

When the actuator expands (FIG. 6C), the volume of the chamber decreases and the flapper 648*b* at the top of the second column 646*b* opens, allowing exhaust flow out of that column. Meanwhile the flapper 648*a* at the tunnel intersection 649–646*b* closes, preventing backflow through the linking tunnel 649.

This cycle continues indefinitely, resulting in a reciprocating pumping action. Like that in the embodiment discussed just previously (FIG. 5), the pump is unidirectional but operates at lower flow than the two-column embodiment discussed first (FIG. 4).

D. Detection

In one preferred configuration for a detection method, a laser source 17 (FIG. 7A) is used to detect either fluorescence or polarization characteristics of a particular agent. The source radiation propagates through an initial segment of waveguide, preferably to a beam-splitter 59 where the radiation is divided into two paths.

From the splitter 59, some of the radiation continues through a reference-channel waveguide to interact with the agent, e. g. sample chemical. The agent is positioned in a preferably open sample column 56, by a micropump according to other aspects of the invention.

Radiation remaining after traversal of the sample column 56 continues along the waveguide to a sample-channel detector 52. This detector generates an output sample signal, usually electronic.

Radiation not directed by the beam-splitter 59 to the sample column 56 proceeds instead along a reference channel, within the waveguide, to a capped reference column 56*r*. Radiation remaining after traversal of the reference column 56*r* continues along the reference channel to a reference-channel detector 52*r*, which generates an output reference signal.

In this system, changes due to the agent can be detected on a fractional basis, by monitoring the ratio of the sample-detector 52 output to the reference-detector 52*r* output. In other words the photon signal coming from the sample channel 56, 52 is normalized to the total amount of energy initially present at the λ source 17—as represented by the signal from the reference channel 56*r*, 52*r*.

All of these configurations can work with the chamber membrane displaced to increase or decrease chamber volume, by configuring the actuator to expand, increasing volume, and contract, decreasing volume. Furthermore, either used alone or combined with a waveguide for detection purposes, the microfluidic pump system of the invention is advantageously further combined with a computer or an integrated processor to automate its monitoring capabilities and responses.

The radiant-energy source (e. g. laser or photodiode), detection method and/or processor may each be integrated into a chem/bio chip 65 (FIG. 7B) along with the microfluidic pump system itself. The overall chip array 65 includes a representative portion 68, 68*e*.

Substantially each region 65*e* of the chip 65 includes numerous waveguide-input and -output optical channels 67, 62 respectively. Sampling columns and pumps 66 are disposed along the guides 67, 62.

This arrangement is especially advantageous for applications in which the entire pump/waveguide system is for implantation in a living body, or within a closed assay system.

The guides 67, 62 can be spaced at 50 μm on centers, or even less. The openings of the chambers 66 can be 10 μm by 10 μm and less. Thus over 20,000 sites are possible on a chip that is 10 mm square.

E. Detection and Distribution

The previously discussed pump/optical-waveguide detection device 840 (FIG. 8) can be used together with a reciprocating microfluidic pump device 846*a'*, 846*b'* as part of a larger system for detection of chemical or biological agents, or both. In such a system, both of the micropump devices are integrated into respective chem/bio chips.

One or more such chips advantageously are still further integrated into a single chip. If desired, such an integrated system can also include one or more detectors 852, 852*r*, processing capability 873, 873*a*, and one or more radiation sources 17 and reservoirs 871' for the agent material. Such a chip advantageously also includes access points 841', 842 to one or more bodily organ or a body's circulatory system 871.

The overall system, or portions of it, are readily implanted in the body or within a closed assay system, or can be used externally. A sample fluid or gas 842 from an organ 871—for example the stomach or the circulatory system—enters the open column of the microfluidic pump 840. These specimen fluids or gases are drawn into the interaction region of the column, which contains the optical-waveguide sensor 867, 862.

Such specimens may be, e. g., bodily secretions such as blood, urine, semen or saliva. Alternatively specimens monitored or pumped in this embodiment—or other embodiments discussed in this document—may be air, water, or any number of industrial or environmental test samples such as exhaust, fuel or lubricant.

Any of these systems may use additional means to direct sample medium to the monitoring column(s). For greater exposure to the sample medium, the system itself may simply be located on a structural support (e. g. located in or on a wall or passageway).

A source 17 of radiant energy e. g. light is aligned with the waveguide inlet 867, which passes the energy to the column containing the specimen. The radiant-energy source 17 may be a simple visible-light source, or other types as indicated in this document or the documents incorporated by reference. (After monitoring, the specimen in the column simply becomes sampling exhaust 941.) Whatever fraction of the energy passes through the specimen in the column, augmented by any fluorescence energy produced by the specimen, continues through the waveguide outlet 862, which then emits an optical signal.

That resulting signal proceeds along an optical fiber or other guide 868 to a detector 852, which may also have an associated reference channel 852*r*. Various detection methods, listed earlier, may be used to interpret this optical signal.

For the sake of simplicity the "Detector" block 852, 852*r* will here be understood to include all such interpretive components, yielding an electrical or other data flow 872. This latter information sequence is then advantageously directed for processing to a separate computer 873, or alternatively to a microprocessor 873*a* that is integrated within the bio/chem chip itself.

The computer or integrated processor can thus monitor the sample and can automate a response by relaying information 870 to another mechanism such as an alarm 874. The response can also be formulated as a signal 871" for control of the reciprocating microfluidic pump, to cause it to appropriately respond based on the resulting data.

The reciprocating microfluidic pump may respond by pumping and thereby expelling drugs or other agents 842' from a reservoir 871' along a return path 841' to the organ etc. 871 that is being monitored. The pump instead may discontinue expelling such agents, depending on which is the appropriate response to the computer- or processor-developed command 871".

Applications of the invention are not limited to monitoring and dosing of a living organism. Thus for instance an industrial process stream, or combustion engine, or environmental sampling system (not shown) can produce a specimen 971 (FIG. 9). Thus the specimen may be, e. g., air, water, exhaust, or fuel lubricant.

This specimen 971 here too proceeds 942 into a system consisting of—in combination—a pump/optical-waveguide detection device 940 together with a reciprocating microfluidic pump device 946*a'*, 946*b'*. The specimen flow 942 is directed to the column 946 of an optical pump/detection module 940, as before.

The elements 941, 946, 962, 967, 968, 952, 952*r* correspond to the previously discussed elements similarly numbered but with prefix "8" instead of "9" (FIG. 8). The radiation source 17 is typically the same here as in other embodiments.

The detector 952, including optional reference channel 952*r* and any associated interpretive modules, produces data 972' that proceed to a separate computer 973. As before an alternative special-purpose processor 973*a* may instead be integrated into the substrates of the invention.

Processor output-data or control signals 970 flow to an alarm or access module 974, or for example to a heating/ventilating/air-conditioning ("HVAC") system 975. The data or control signals 970 can instead control a chemical-processing module 976, or a fuel-injection module 979; in these latter cases actual physical chemical or fuel flows 971" proceed to become inputs 942' to the pump unit 946*a'*, 946*b'*. The appropriate automated monitoring response in all of these embodiments depends on the application or goal of the system and its connected components.

The HVAC automated monitoring response may be as simple as turning on or off vents or circulating fans without the need for turning on a reciprocating micropump. On the other hand, an automated fuel injection system response may require a reciprocating micropump to draw minute amounts of fuel 979 from a reservoir 971' and pump it into an engine or other reaction vessel 981 in a controlled fashion.

(This part of the system is illustrated only very diagrammatically, as the paths 976, 979, 971" may represent either [a] fluid flows entering the pump 946*a'*, 946*b'* or [b] control signals to operate the pump 946*a'*, 946*b'*.)

Likewise, automated monitoring of a chemical processing system may require a reciprocating micropump to draw distinct amounts of chemical or biological agents from a reservoir and pump them into a reaction vessel. The appropriate automated monitoring response in these examples depends on the application or goal of the system and its connected components.

The pump unit may receive at 942', instead of fuel or other chemicals from the computer-controlled modules 979, 976, separate quantities of agent from a reservoir 971'. In either case the pump ejects the pumped fluid 941' to a reaction vessel 981 for further physical processing, and/or back as process-control samples 941' to the monitoring-stage input flow 942.

The reciprocating microfluidic pump system can be used for a variety of applications that require pumping of distinct and minute amounts of liquids or gases. The invention is not limited to these examples.

As yet another group of examples, the reciprocating microfluidic pump 1046*a*, 1046*b* (FIG. 10) can be used simply as a delivery system, without necessarily any provision for monitoring. Here the pump draws in gas or liquid 1042 such as printer ink from a reservoir 1071 and expels the agent at 1041 in a discrete and controlled manner for applications such as an intravenous ("IV") drip 1086, a microassay sample slide 1085, a fuel injector system 1079, chemical processing system 1076, or even a printer 1084 (in the case of printer ink).

Certain preferred embodiments of the invention have been commercialized under the trade name "LightLinks"—which is a trademark for a proprietary system of Areté Associates. Some forms of that system include a microfluidic pump, diaphragm membrane, waveguide-based optical interconnecting channel, and actuator substrate.

The foregoing disclosures are merely exemplary of the present invention, whose scope is to be determined by reference to the appended claims.

I claim:

1. A miniaturized fluid pump system comprising:

a substrate;

at least one controllable expansion-and-contraction chamber formed in the substrate;

a pair of substantially microscopic ducts, respectively communicating with a fluid source and a fluid destination;

and at least one of the ducts communicating with the chamber;

a linking tunnel, distinct from the chamber, formed in the substrate and communicating with both ducts; and at least one exclusively passive valve interacting with fluid pressures due to expansion and contraction, respectively, to impose a directionality upon fluid flow in the ducts and tunnel.

2. The pump system of claim 1, wherein:

the valve is a passive flapper.

3. The pump system of claim 1, wherein:

the substrate is implanted within a living creature.

4. The pump system of claim 3, wherein:

the fluid source is a chamber for medication to be delivered to the creature.

5. The pump system of claim 4, wherein:

the chamber is also implanted within the creature.

6. The pump system of claim 1, wherein:

the fluid source is a fuel tank; and the fluid destination is a substantially microscopic engine.

7. The pump system of claim 1, wherein:

the fluid source provides a specimen for assay; and the fluid destination is a slide for observation.

8. The pump system of claim 7:

in further combination with a microscope; and wherein:

the slide is for human observation under the microscope.

9. The pump-system-and-microscope combination of claim 8, wherein:

the microscope is an electron microscope.

10. The pump system of claim 7:

in further combination with automatic-examination means; and wherein:

the slide is for automatic examination by the automatic-examination means.

11. The pump system of claim 1, wherein:
the fluid source is a reagent; and
the fluid destination is a process stream.

12. The pump system of claim 1, wherein:
the fluid source is a colorant; and
the fluid destination is a colorant application system.

13. The pump system of claim 1, in further combination with an optical monitoring device comprising:
a monitoring-device substrate;
formed in the monitoring-device substrate, a channel for passage of an optical signal;
intersecting the optical-signal channel, a column for movement of fluid into and out of the optical-signal channel, for optical monitoring of the fluid.

14. The combined pump system and optical monitoring device of claim 13, further comprising:
means for displacing fluid along the column to control placement of the fluid relative to the optical-signal channel, for optical monitoring of the fluid.

15. The combined pump system and optical monitoring device of claim 14, wherein:
the monitoring-device substrate is substantially integrated with the pump-system substrate.

16. The combined pump system and optical monitoring device of claim 1, further comprising:
another controllable expansion-and-contraction chamber, formed in the substrate and communicating with the column.

17. The combined pump system and optical monitoring device of claim 16, wherein:
the monitoring-device substrate is substantially integrated with the pump-system substrate.

18. The combined pump system and optical monitoring device of claim 13, wherein:
the monitoring-device substrate is substantially integrated with the pump-system substrate.

19. A method for moving a fluid from a fluid source to a fluid destination; said method comprising:
disposing the fluid in a miniaturized fluid pump system that comprises:
a substrate,
at least one controllable expansion-and-contraction chamber formed in the substrate,
at least two substantially microscopic ducts, communicating with the fluid source and with the destination,
at least one linking tunnel, distinct from the chamber, formed in the substrate and aligned with at least two of the ducts, and
at least one exclusively passive valve interacting with fluid pressures due to expansion and contraction, respectively, to impose a directionality upon fluid flow in the at least one chamber and the at least two ducts; and
controlling expansion and contraction in the at least one chamber, to drive fluid from the source to the destination.

20. The method of claim 19, further comprising the step of:
observing a specimen of the fluid, and wherein:
the fluid source provides the specimen for assay; and
the fluid destination is a slide for observation.

21. The method of claim 20, wherein:
the observing step comprises observation under a microscope; and
the slide is for human or machine observation under a microscope.

22. The method of claim 20, wherein:
the observing step comprises observation under an electron microscope; and
the microscope is an electron microscope for human or machine observation of the specimen.

23. A miniaturized fluid pump system comprising:
a substrate having at least one generally planar surface;
at least one controllable expansion-and-contraction chamber formed in the substrate;
a first microscopic straight duct formed in the substrate and intersecting said surface substantially at right angles, and communicating directly with the chamber;
a second substantially straight duct formed in the substrate substantially parallel to the first duct and also intersecting said surface;
one of said ducts communicating with a fluid source and the other of said ducts communicating with a fluid destination;
a linking tunnel, distinct from the chamber, formed in the substrate substantially parallel with said surface and communicating with both ducts; and
at least one valve associated with each of said ducts, respectively, and interacting with fluid pressures due to expansion and contraction to impose a directionality upon fluid flow in the ducts and tunnel.

24. The pump system of claim 23, wherein:
each of the at least one valves is an exclusively passive valve.

25. The pump system of claim 23, in further combination with an optical monitoring device comprising:
a monitoring-device substrate;
formed in the monitoring-device substrate, a channel for passage of an optical signal;
intersecting the optical-signal channel, a column for movement of fluid into and out of the optical-signal channel, for optical monitoring of the fluid.

26. The combined pump system and optical monitoring device of claim 25, further comprising:
means for displacing fluid along the column to control placement of the fluid relative to the optical-signal channel, for optical monitoring of the fluid.

27. The combined pump system and optical monitoring device of claim 26, wherein:
the monitoring-device substrate is substantially integrated with the pump-system substrate.

28. The pump system of claim 23, further comprising:
another controllable expansion-and-contraction chamber, formed in the substrate and communicating with the column.

29. The combined pump system and optical monitoring device of claim 28, wherein:
the monitoring-device substrate is substantially integrated with the pump-system substrate.

30. The combined pump system and optical monitoring device of claim 25, wherein:
the monitoring-device substrate is substantially integrated with the pump-system substrate.

* * * * *